US005501376A

United States Patent [19]

Roda-Balzarini

[11] Patent Number: 5,501,376

[45] Date of Patent: Mar. 26, 1996

[54] DEVICE FOR PROVIDING ASSISTANCE IN DONNING GARMENTS EQUIPPED WITH SLEEVES

[76] Inventor: Emilio Roda-Balzarini, Via al Ruscello 6, 6962 Viganello, Switzerland

[21] Appl. No.: 294,303

[22] Filed: Aug. 23, 1994

[30] Foreign Application Priority Data

Jul. 19, 1994 [CH] Switzerland ..... 02283/94

[51] Int. Cl.[6] ..... A47G 25/80; A47G 25/90; A41H 5/00

[52] U.S. Cl. ..... 223/111; 223/120

[58] Field of Search ..... 223/111, 116, 223/120, 1, DIG. 2; 248/125; 211/1.51, 1.57; 198/466.1, 468.6

[56] References Cited

U.S. PATENT DOCUMENTS

| | | | |
|---|---|---|---|
| 609,427 | 8/1898 | Griffith | 223/111 |
| 612,623 | 10/1898 | Benesh | 223/111 |
| 624,848 | 5/1899 | McCausland | 223/111 |
| 2,811,293 | 10/1957 | Holm | 223/111 |
| 3,915,313 | 10/1975 | Thur et al. | 211/1.57 |
| 4,892,239 | 1/1990 | Tomasi | 223/111 |
| 5,183,162 | 2/1993 | Ritzenhaler | 211/1.57 |

*Primary Examiner*—C. D. Crowder
*Assistant Examiner*—Bibhu Momanty
*Attorney, Agent, or Firm*—Young & Thompson

[57] ABSTRACT

A device is able to provide assistance to a person in donning a garment (10) equipped with sleeves. This device includes fixed tubular elements (2); movable parts (3) which are attached to the tubular elements (2) in such a way as to be able to slide along a path composed of a vertical segment (v) and a subsequent horizontal segment (o) of the tubular elements (2); pincers (4) which are supported by the movable parts (3) and which are able to grasp a part of the garment (10), holding it over the entire path; a drive motor (6) which is able to cause the movable parts (3) to translate along the path in both directions of motion; and a base which supports the entire device that is adjustable in height.

7 Claims, 4 Drawing Sheets

DEVICE FOR PROVIDING ASSISTANCE IN DONNING GARMENTS EQUIPPED WITH SLEEVES

BACKGROUND OF THE INVENTION

1. Field of the Invention

This invention pertains to the area of devices for assisting persons suffering from a handicap or disability, even of a transient nature, which keeps them from making full or proper use of their arm joints or shoulders.

2. Description of the Related Art

The inventor has noted that, owing to conditions of arthrosis, arthritis, etc., as well as to simply the sequelae of previous traumas involving the arms, the shoulders and/or the torso, many people, particularly those of advanced years, experience serious and sometimes insurmountable problems in donning garments equipped with sleeves, e.g., shirts, jackets, or overcoats.

SUMMARY OF THE INVENTION

The inventor has thus set himself the goal of providing a device which, while being simple and practical, is able to actually assist users in donning garments of the type described, allowing them to avoid making the unnatural movements and the contortions that would often be necessary otherwise.

BRIEF DESCRIPTION OF THE DRAWINGS

The operation of said device and the advantages that are achieved with it will be made clearer in the detailed description that will be provided, in which reference will also be made to the attached drawings, where.

DETAILED DESCRIPTION OF THE PREFERRED EMBODIMENTS

Figure 1:
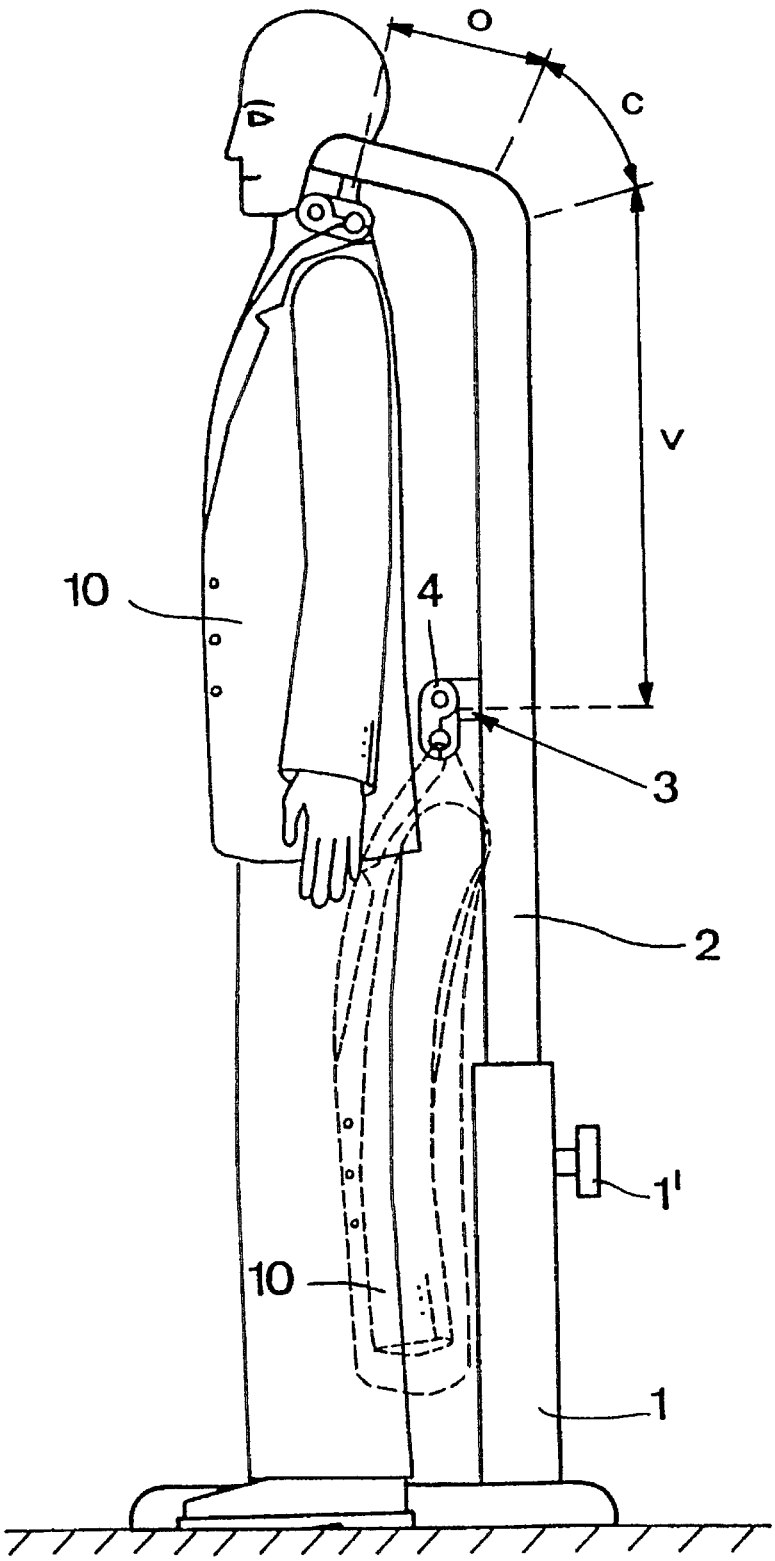
FIG. 1 presents a schematic side view of a device according to the invention, showing the paths of the grasping members with respect to the user's body.
Figure 6:
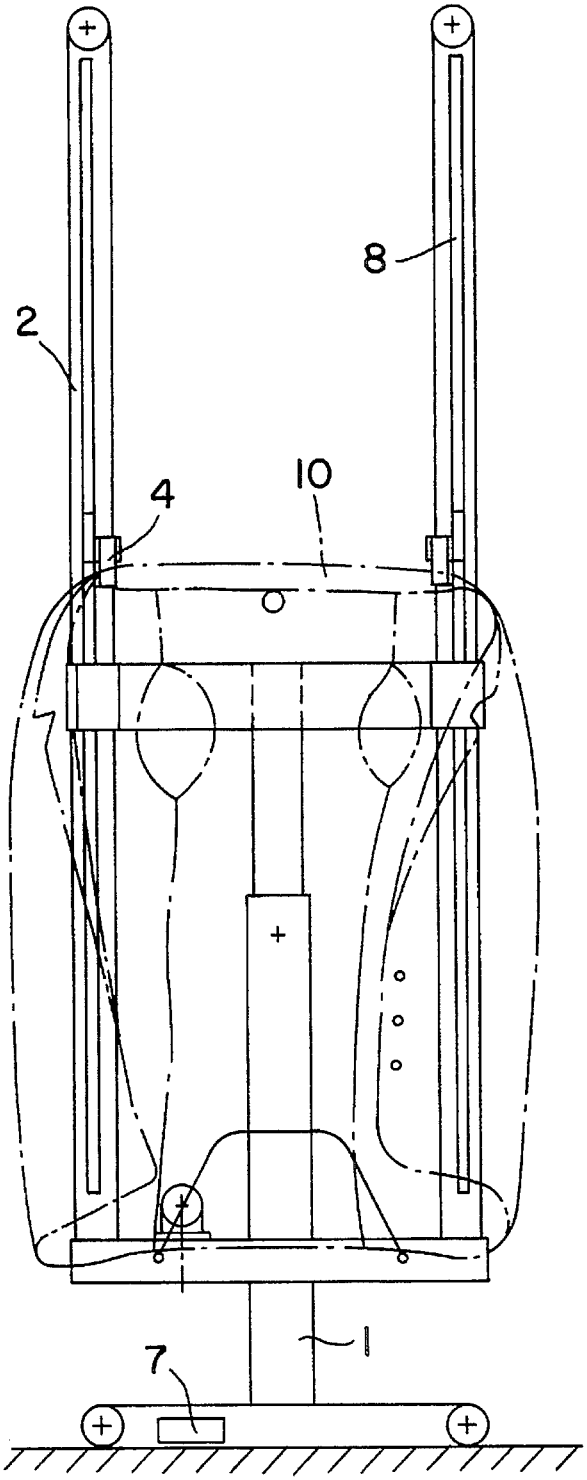
FIG. 6 shows the same view as FIG. 3 with a shirt suspended at the instant when the device begins to operate.

The inventor has determined how it is possible to assist a person in donning a garment 10 that is equipped with sleeves by suspending, with appropriate pincers 4, garment 10 in the vertically extended position (see FIG. 6), with the entry holes of the sleeves opened wide, and by causing the pincers 4 themselves to travel along a path (FIG. 1) in such a way as to raise the garment 10 (segment v), into whose sleeves the user has first slipped his hands, up to the height of the shoulders, and then moving it approximately horizontally (segment O) toward the user's body until the collar of garment 10 has reached a point near the neck.

By now unlocking pincers 4, opening them and releasing garment 10, the user will now have donned the garment 10 without having had to rotate his arms or torso.

To accomplish this operation, the device in question can be implemented in a number of different ways, two of which are favored by the inventor (but which are neither limiting nor restrictive) and are described below.

Figure 2:
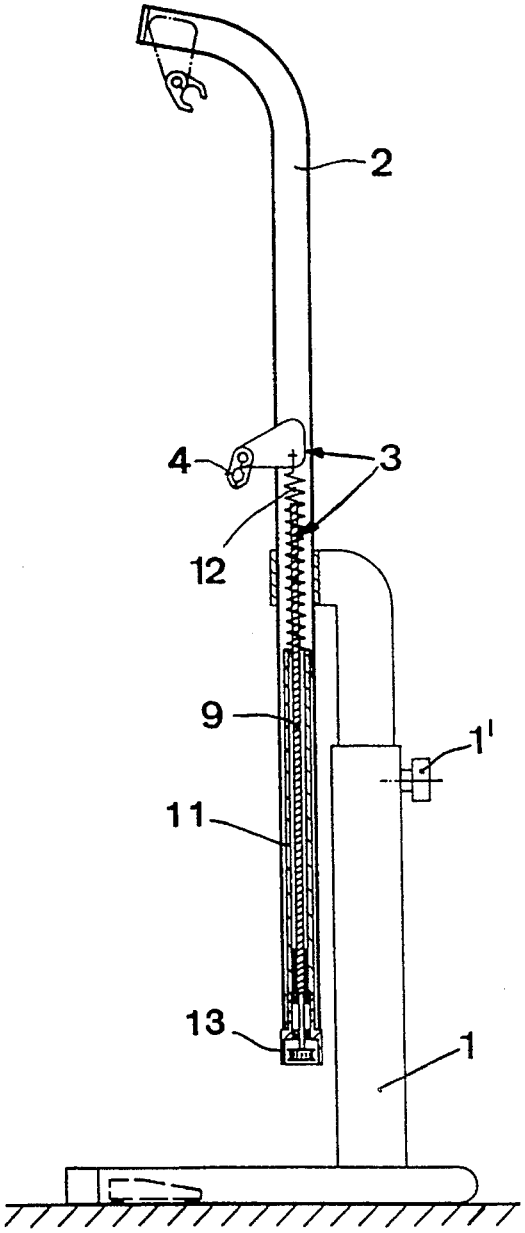
FIG. 2 presents a side view with a partial cut-away of an embodiment of the invention in which the moving of the movable parts is done by means of a screw-and-nut system.
Figure 3:
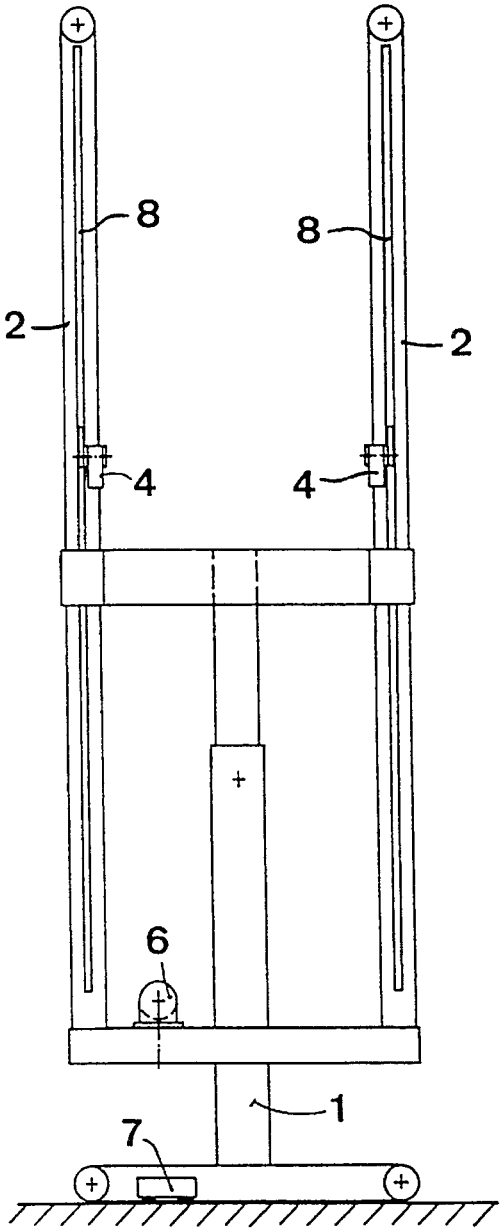
FIG. 3 shows a front view of the embodiment of FIG. 2.

In the first embodiment (FIGS. 2 and 3), the support structures used are two hollow tubular elements 2 which have a vertical segment and a basically horizontal segment; said segments are connected by a curved part.

Both of the tubular elements 2 have a full-length groove 8 over virtually their entire length.

In the lower part of each tubular element 2, on the inside, are the following: a threaded pin 9 and a nut 13 that is engaged with said pin 9 and is firmly attached to a bolt 11, which is also aligned coaxially inside tubular element 2.

At the upper end of said bolt 11, there is attached a helical spring 12 which is of a predetermined length and is selected in such a way as to have considerable flexibility, and to the upper end of said spring 12, there are attached the pincers 4, which are shaped and attached in such a way as to be able to slide along said full-length groove 8, extending outside of tubular element 2, with its parts being prepositioned for grasping a garment 10.

Nut 13 is mounted by known methods in such a way that, after threaded pin 9 is turned and since said nut 13 is coaxial inside of said pin 9, said nut 13 is able to translate only and cannot be dragged along with the rotational movement owing to the friction of threaded pin 9 itself. The latter is attached at its lower end to transmission parts 3, which are either toothed or of another type and which, by means of known systems, connect them to a small electric motor 6 mounted on 9 support base 1, which supports tubular elements 2. When the small motor 6 drives, its rotation causes threaded pin 9 to rotate and consequently causes nut 13 to translate, along with bolt 11 which is securely attached to said nut 13, consequently causing helical spring 12 and pincers 4, which are attached to said nut 13, to turn as well. When small motor 6 drives in the upward direction of pincers 4, said pincers 4 then slide along groove 8 and travel along an essentially L-shaped path (corresponding to segments v, o, c in FIG. 1) along tubular element 2. The last, approximately horizontal segment can, in point of fact, be traversed owing to the flexibility of spring 12, which readily adapts to the shape of said tubular element 2.

The same producer occurs with regard to the other tubular element 2, and since the transmission parts between small motor 6 and two threaded pins 9 are dimensioned in such a way as to ensure the identical linear movement of two pincers 4 as motor 6 accomplishes the same rotation, the garment (10 in FIG. 6) is lifted parallel to itself in the way described above.

The inventor states that small motor 6 is to be actuated by means of a pedal switch 7 located in the lower part of support base 1 of the device.

When depressed, said pedal 7 can cause the motor 6 to drive in such a way as to raise pincers 4 and lower them when released, or said pedal 17 can regulate the various phases of the operation with the aid of a programmer device of a known type that is already used for household appliances, or it can operate in different ways as dictated by the particular requirements of the user.

Pincers 4 are thus equipped with basically known mechanical or magnetic systems which cause them to release and open when they reach their end-of-travel positions at the ends of the horizontal segments, thus releasing the garment 10, which has now been donned.

Figure 4:
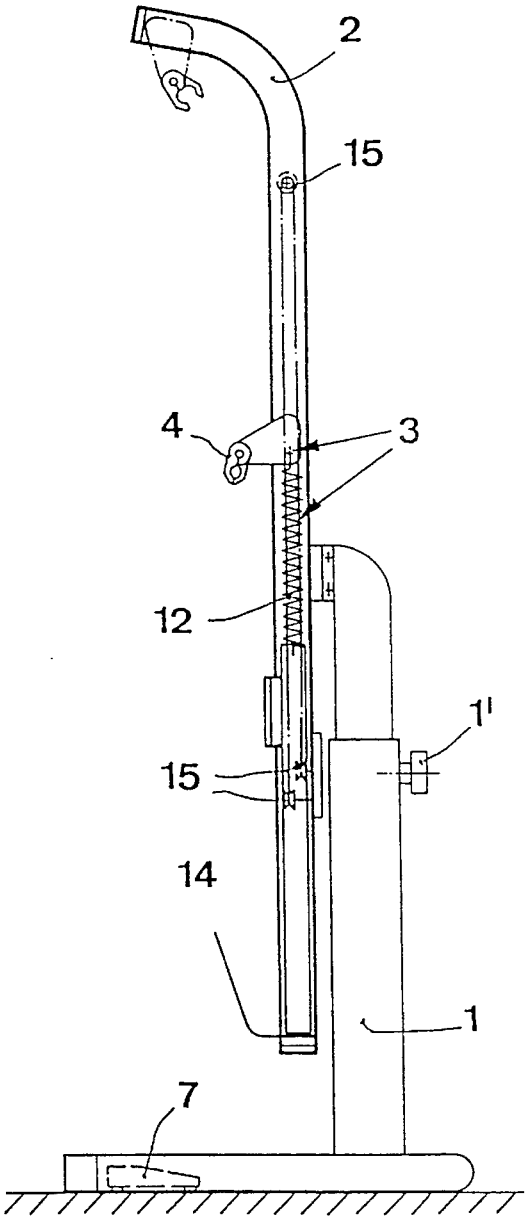
FIG. 4 presents a side view with a partial cut-away of another embodiment of the invention in which the moving parts are moved by means of a system of tie rods and pulleys.
Figure 5:
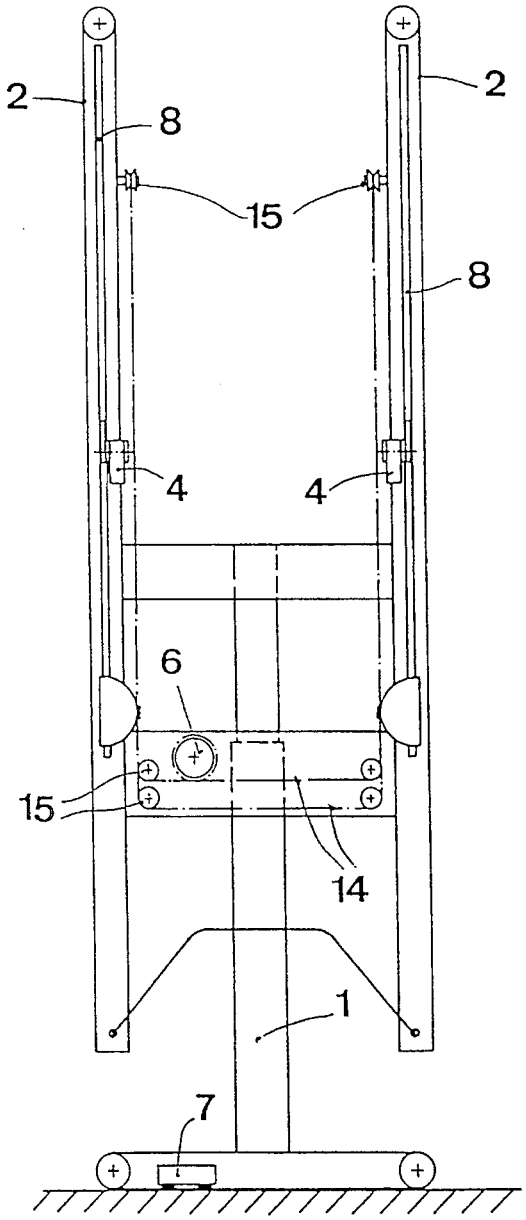
FIG. 5 shows a front view of the embodiment of FIG. 4.

A second sample embodiment is depicted in FIGS. 4 and 5. The operation of the device is quite similar to that described above, and all of the various working parts are also quite similar, except for those which are prepositioned in order to convey motion between the small electric motor 6 and helical springs 12 which support pincers 4. As said FIGS. 4 and 5 show, said pincers 4 are composed of a system of retractable tie rods 14 which interconnect motor 6 and springs 12, and ultimately pincers 4, via return pulleys 15 in such a way as to be able to move said pincers 4, themselves in both directions of motion, thereby ensuring the identical translation each time said small electric motor 6 accomplishes the same rotation.

The individual design details are not presented here since they refer to drive systems which are otherwise familiar to persons skilled in the art.

The power supplied by the small electric drive motor 6 is selected in such a way as to be able to accomplish one operating cycle within a reasonably short time without, however, giving rise to the risk of pulling on or otherwise injuring the user through abrupt movements.

In order to achieve good results along these lines, a friction coupling is inserted between the small motor 6 and the devices driven by it, regardless of what form said parts may take in various embodiments, in such a way as to limit the torque that can be transmitted in any case. This kind of approach is not depicted but is readily imaginable for one skilled in the field of mechanics.

In order to make it possible for the device to be used regardless of the user's height, the inventor has thus made provision for designing the support base 1 overall in such a way as to be adjustable in height by means of, e.g., coaxial telescoping or toothed devices which are equipped with a locking device 1'.

It is clear that the two examples described and depicted here do not exhaust all of the possible embodiments of a device according to the invention, which embodiments can be implemented by modifying the shape of the component parts, but even such embodiments will remain within the scope of the protection conferred by this patent since they are based on what is presented in the attached claims.

I claim:

1. Device for providing assistance to a user in donning a garment (10) equipped with sleeves, wherein said device comprises:

a) two matching tubular element (2), including a vertical element essentially shaped like an L at an upper end segment;

b) movable parts (3), each of which is connected to one of said elements (2) and is free to slide along an essentially L-shaped path in the tubular elements (2);

c) pincers (4) which are firmly attached, respectively, to said movable parts (3), and which grasp a part of the garment (10) to be donned without creasing while traveling along the L-shaped path, said pincers (4) further being equipped to open at the end of said L-shaped path;

d) an electric motor (6) which is attached to the movable parts (3) and which is equipped with one or more pedal switches (7) to ensure drive in both directions of motion, as well as to ensure stoppage; and e) a base (1) which supports the device.

2. Device according to claim 1, wherein:

the tubular elements (2) have an essentially horizontal segment connected to a curved part in a full-length groove (8).

3. Device according to claim 2, wherein said movable parts (3) include helical springs (12) of predetermined length which are inserted into said tubular elements (2), each of which has at an upper end the pincers (4) which are shaped in such a way as to be able to slide along said full-length grooves (8) while extending through the respective tubular element (2).

4. Device according to claim 1, in which one or more pedal switches (7) are located in a lower part of the base (1).

5. Device according to claim 1, in which said electric motor (6) and the parts to be driven are separated by one or more friction couplings in order to limit the torque that can be transmitted by the electric motor (6).

6. Device according to claim 1, in which, at an end of each of the tubular elements (2), there is an end-of-travel stop which is able to cause the pincers (4) to open.

7. Device according to claim 1, wherein the base (1) can be adjusted in height depending on the user.

* * * * *